United States Patent [19]

Ross

[11] 4,072,397

[45] Feb. 7, 1978

[54] MIRROR ATTACHMENT FOR SHOWER HEAD

[76] Inventor: Thomas H. Ross, 201 E. Monterey Way, Phoenix, Ariz. 85012

[21] Appl. No.: 711,487

[22] Filed: Aug. 4, 1976

Related U.S. Application Data

[63] Continuation-in-part of Ser. No. 610,653, Sept. 5, 1975, abandoned.

[51] Int. Cl.[2] ..... G02B 5/08

[52] U.S. Cl. ..... 350/61; 4/145

[58] Field of Search ..... 350/61, 63; 248/475 R, 248/476, 479, 230, 231; 4/145, 146

[56] References Cited

U.S. PATENT DOCUMENTS

| | | | |
|---|---|---|---|
| 2,137,881 | 11/1938 | Margulies | 350/288 UX |
| 3,373,448 | 3/1968 | Butler | 350/61 UX |
| 3,594,063 | 7/1971 | Smillie | 350/61 |

*Primary Examiner*—John K. Corbin
*Assistant Examiner*—Matthew W. Koren
*Attorney, Agent, or Firm*—Don J. Flickinger

[57] ABSTRACT

A panel has a reflective surface and a back surface. Support means engageable with a shower head holds the panel in a position in which water from the shower head is received against the back surface. Heated water from the shower head, received against the back surface, prevents condensation upon the reflective surface. The panel is movable to a position remote from the stream of water from the shower head for normal bathing activities.

15 Claims, 18 Drawing Figures

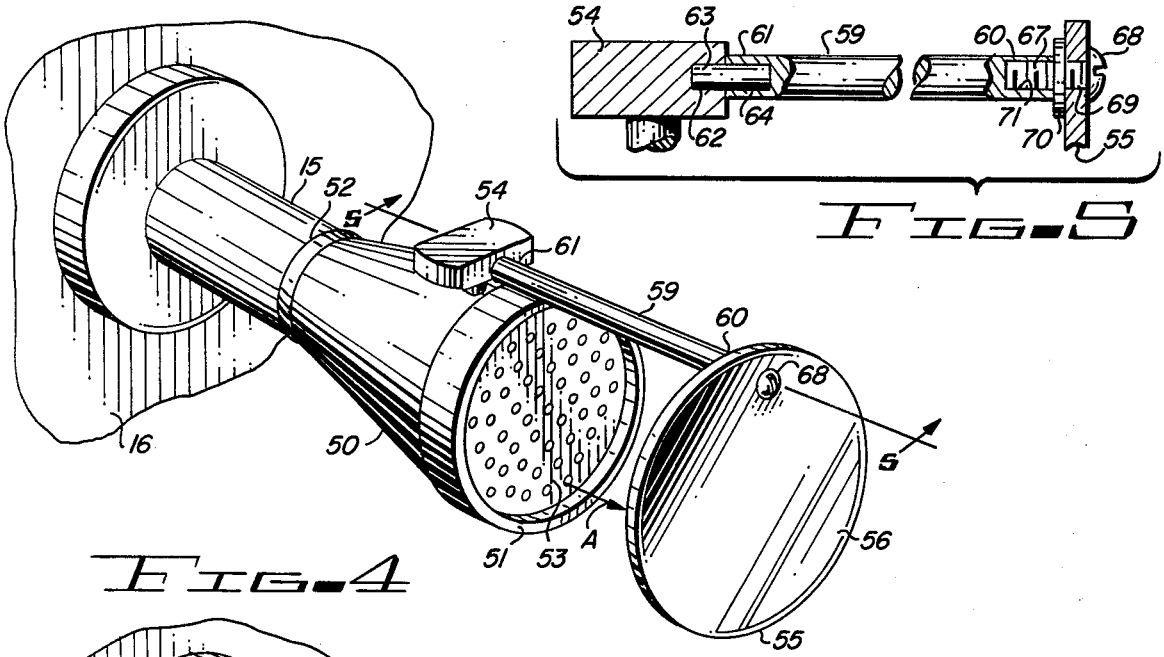
FIG. 5
FIG. 4
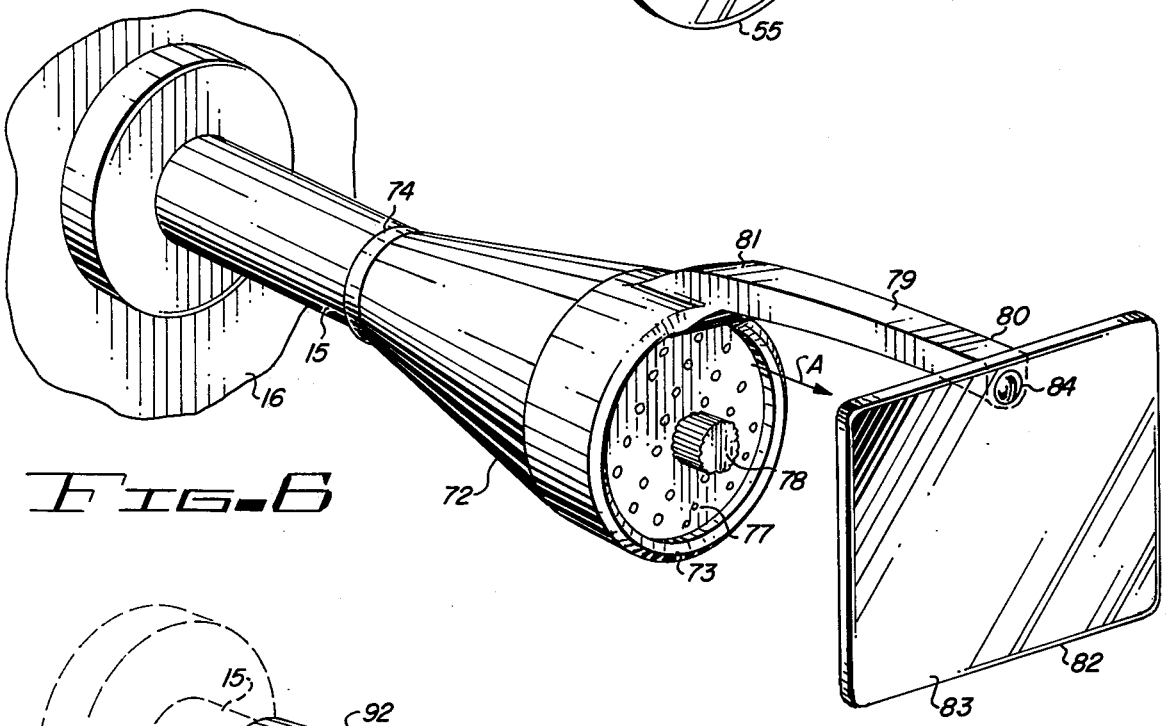
FIG. 6
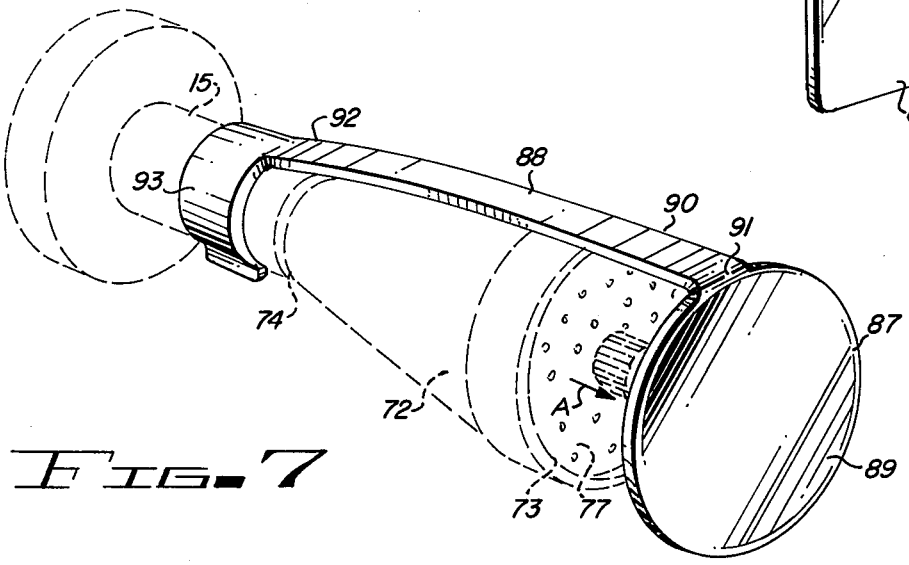
FIG. 7

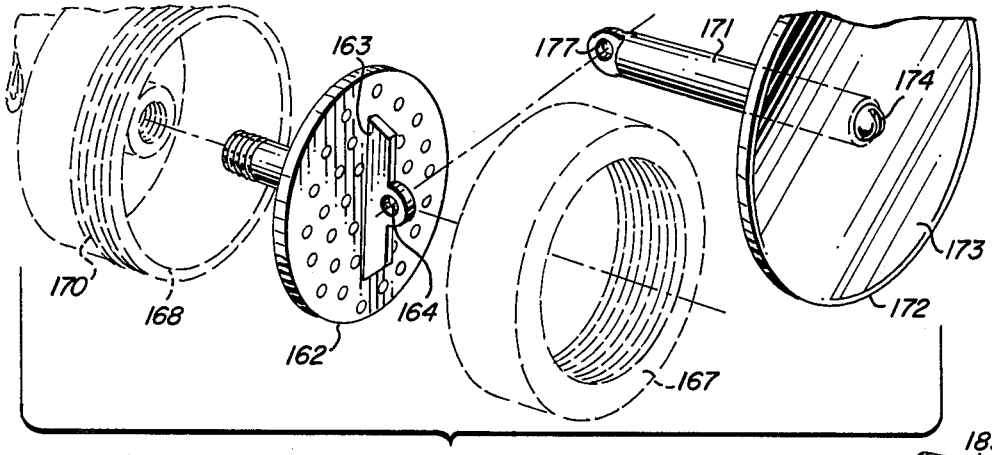
FIG. 13
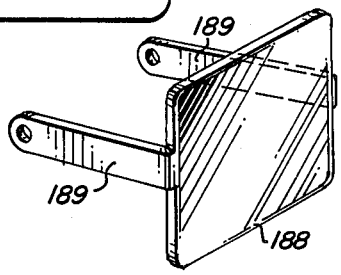
FIG. 15
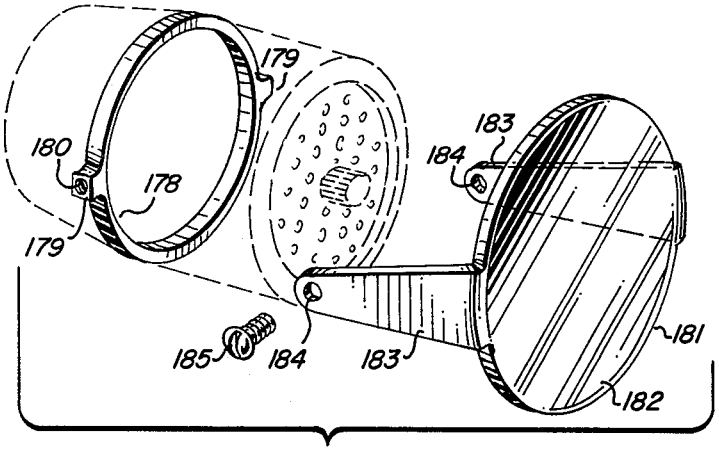
FIG. 14
FIG. 17
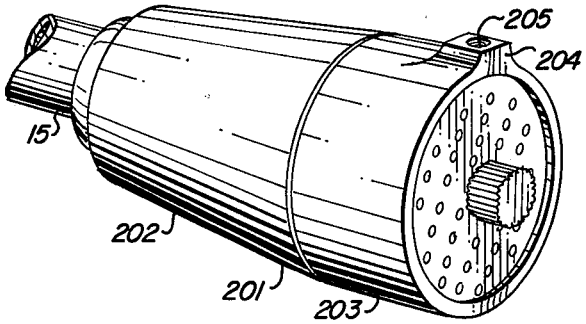
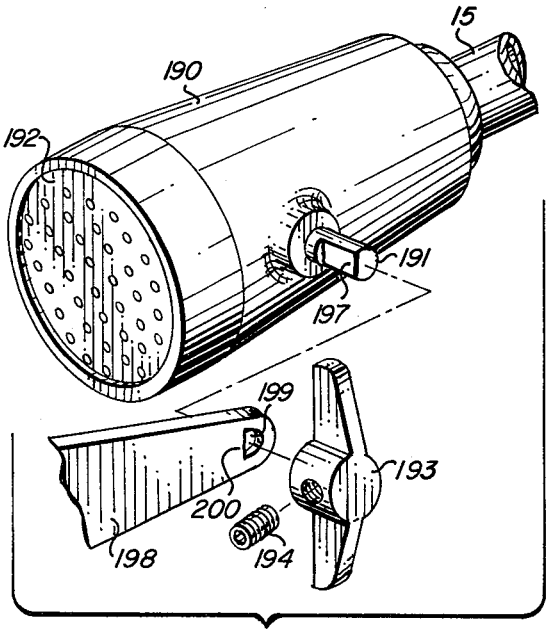
FIG. 16
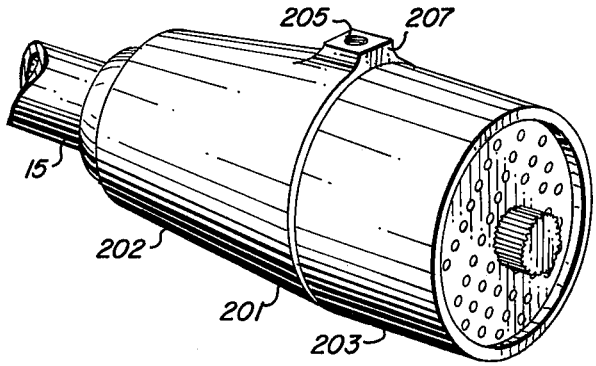
FIG. 18

MIRROR ATTACHMENT FOR SHOWER HEAD

The instant application is a continuation-in-part application of the present applicant's prior filed copending United States patent application, Ser. No. 610,653, filed Sept. 5, 1975, entitled "Mirror Attachment for Shower Head", now abandoned.

This invention relates to mirrors.

More particularly, the instant invention concerns a mirror for use in steamy environments.

In a further aspect, the present invention concerns a toilet or vanity mirror for bathing and shower convenience.

The desirability of providing a mirror for bathing and shower use is clearly evident. It is well established, for example, that, in addition to the convenience of shaving while showering, males generally agree that the process of shaving is greatly enhanced when conducted in a warm, humid environment. Certain female cosmetic functions, such as attending to the hair, are also conveniently practiced in the shower. These functions are more conveniently accomplished with the use of a mirror. However, it is well known that a mirror is rendered relatively useless by the condensation of moisture on the reflecting surface from the steam generated by the hot bathing water.

Various prior art attempts have been made to provide a mirror especially adapted for shower use. A relatively simple proposal is a sheet metal mirror which is installed on the wall of a shower enclosure. It is intended that the heat within the enclosure is substantial to warm the mirror, thus preventing the condensation of moisture thereon. Since the temperature of the wall remains substantially below that of the steam, the results yielded are less than satisfactory. Another prior art device is a mirror which is heated by hot water moving through an arrangement of conduits which are in contact with the reverse side of the mirror. While apparently functioning adequately, the device is extremely complex in construction and in installation and requires physical connection with a hot water outlet.

It would be highly advantageous, therefore, to provide an improved mirror for use in steamy, high temperature high humidity, environments.

Accordingly, it is a primary object of the present invention to provide a mirror having a reflective surface which is not rendered useless due to condensation caused by high humidity.

Another principal object of the present invention is the provision of a vanity mirror for bathroom use.

Yet another object of the present invention is to provide a mirror for toilet use during bathing or showering.

Still another object of the present invention is to provide a mirror which is readily detachably secureable to a shower head.

Yet still another object of the invention is the provision of a mirror which will utilize hot water from the shower to prevent the condensation of moisture upon the reflective surface.

And a further object of the invention is to provide a mirror of the above type which will not interfere with regular shower usage.

And a still further object of the instant invention is to provide a bathroom vanity mirror which is simply constructed, inexpensively manufactured and reliably useable.

Briefly, the achieve the desired objectives of the present invention in accordance with a preferred embodiment thereof, provided is a relatively thin panel, having a reflective front surface. Attachment means engageable with the conventional shower head holds the panel in such a manner that heated water from the shower head is received against the back surface of the panel and warms the panel sufficiently to prevent the condensation of moisture upon the reflective surface. When not in use, the panel is moved to a position which will not interfere with the normal flow of water from the shower head. In accordance with an embodiment of the invention, the support means includes an arm extending rearwardly from the panel and a clamp which is detachably engageable with the shower head. In accordance with an alternate embodiment, the panel is pivotally movable to a position remote from the stream of water. In accordance with the instant invention, the term "shower head" as used herein includes not only the conventional barrel-shaped portion containing the spray nozzle, but also the usual length of pipe or conduit which supports the barrel-shaped portion and delivers water thereto.

The previously stated and further and more specific objects and advantages of the present invention will become immediately apparent to those skilled in the art from the following detailed description thereof taken in conjunction with the drawings, in which:

FIG. 4 is a perspective view of an alternate embodiment of the instant invention as it would appear when attached to the spray adjusting knob of a conventional shower head;

FIG. 5 is a vertical sectional view, taken along the line 5—5 of FIG. 4, and further illustrating the elements of the embodiment thereof;

FIG. 6 is a perspective view of an alternate embodiment of the instant invention which is integrally formed with a shower head;

FIG. 7 is a perspective view of another alternate embodiment of the instant invention which is especially adapted for detachable engagement with a shower head;

FIG. 13 is an exploded perspective view of an embodiment of the invention, in which the shower head, also illustrated in exploded perspective view, is modified for use in combination with the invention;

FIG. 14 is an exploded perspective view of yet a further alternate embodiment of the instant invention, the shower head being shown in dashed out line;

FIG. 15 is a perspective view of an embodiment of the invention generally corresponding to the embodiment of FIG. 14;

FIG. 16 is an exploded perspective view of a particular type of shower head, and particularly illustrating mounting means in accordance with the instant invention for use therewith;

FIG. 17 illustrates a conventional shower head which has been modified to receive a mirror attachment in accordance with an embodiment of the instant invention; and FIG. 18 is a perspective view of a shower head generally corresponding to the shower head of FIG. 17, and having alternate mounting means associated therewith.

Figure 1:
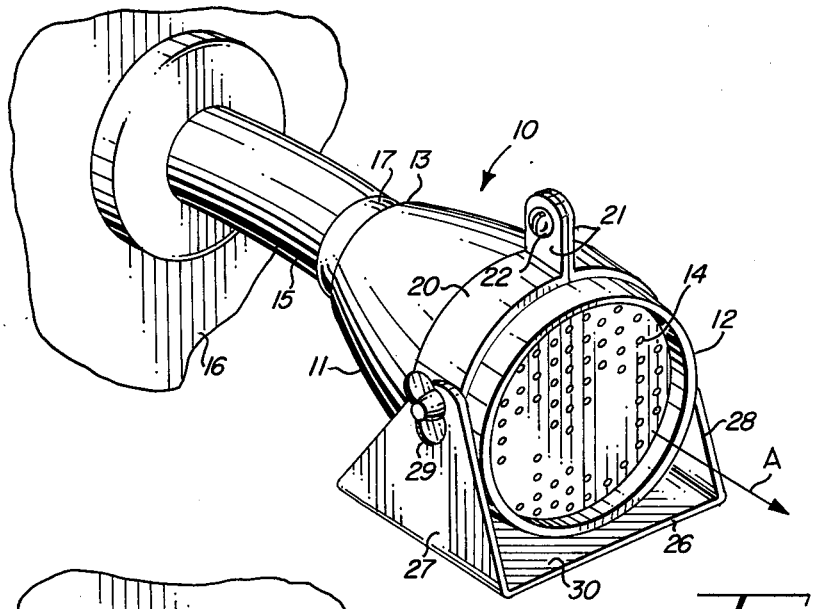
FIG. 1 is a perspective view of a mirror attachment in accordance with a preferred embodiment of the present invention, as it would appear when engaged with a conventional shower head and positioned to not interfere with the normal waterspray function of the shower head.

Turning now to the drawings in which the same reference numerals indicate corresponding elements throughout the several views, attention is first directed to FIG. 1 which shows a shower head 10 having a barrel portion 11 which is generally representative of devices of this nature. Barrel portion 11 has a forward end 12 and a rearward end 13. In accordance with conventional practice, water is emitted from forward end 12 in the direction of arrow A through spray member 14 which is provided with appropriate apertures for this purpose. Water delivery conduit 15 extending from wall 16, again in accordance with conventional practice, is connected to rearward end 13 by swivel joint 17. The term "shower head", as used herein, is defined as including the barrel portion, the swivel, the water delivery conduit, and all related elements which project beyond the wall, and all corresponding and similar components of other specific embodiments, as are well known in the art.

In accordance with the mirror attachment of the instant invention, clamp means are provided by a band 20 sized and shaped to encircle barrel member 11. Each end of band 20 terminates with an upturned ear 21, through which is passed bolt 22. Although not herein specifically illustrated, bolt 22 engages with a nut which when tightened urges ears 21 together, tightening band 20 about barrel portion 11. A pair of diametrically opposed threaded studs 23 extend from band 20. It will be appreciated that only one stud 23 appears in the instant illustration.

A relatively thin, flat panel 26 has a pair of arms 27 and 28 extending rearwardly therefrom. In accordance with the instant embodiment, arms 27 and 28 are integral with the lateral edges of panel 26 and include apertures (not shown) through which studs 23 extend. A wing nut 29 is threadedly engaged with each stud 23 and provide detent means for positionally retaining panel 26.

Figure 2:
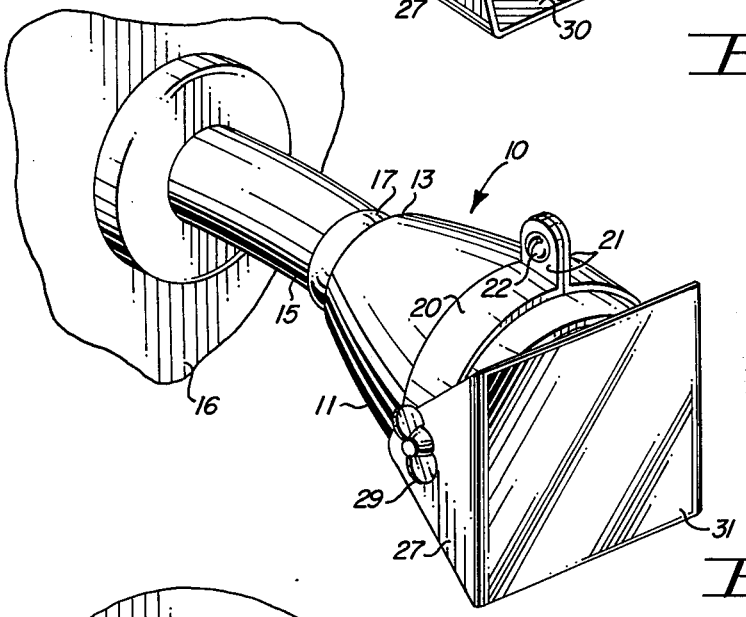
FIG. 2 is a perspective view corresponding to the illustration of FIG. 1, except showing the mirror attachment of the instant invention in the functional position.

Panel 26 has a back surface 30 as seen in FIG. 1 and a front reflective surface 31, as viewed in FIG. 2. In accordance with a preferred manufacturing technique, panel 26 and arms 27 and 28 are an integral stamping of sheet metal, such as aluminum or stainless steel. Front reflective surface 31 is polished to a mirror finish.

As seen in FIG. 2, panel 26 is retained in a first position in which heated water discharged through spray member 14 is received against back surface 30. The heated water raises panel 26 to a temperature that prevents the condensation of moisture from the steamy shower stall environment upon reflective surface 31. In this position, the device of the instant invention provides a mirror which is usable in the shower for shaving, hair arrangement and other vanity purposes. Panel 26 further prevents the spray of water into the user's face, without the necessity of turning off the water. As seen in FIG. 1, panel 26 is pivotally movable to a second position remote from water being discharged from spray member 14, whereby the shower head is usable in the normal manner.

Figure 3:
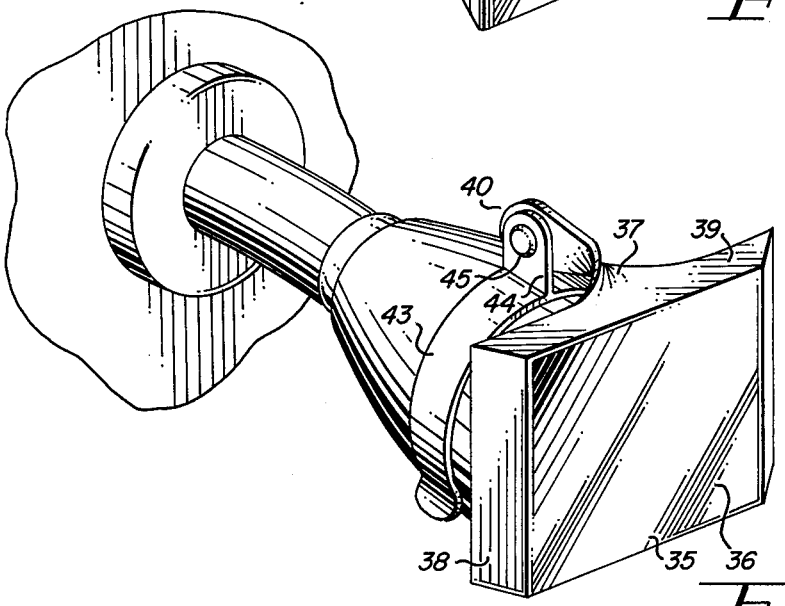
FIG. 3 is a perspective view of an alternate embodiment of the present invention as it would appear when engaged with a shower head and placed in the use position.

With particular reference to FIG. 3, an alternate embodiment of the mirror attachment of the instant invention is illustrated. Similar to the previously described embodiment, flat panel 35 has a front reflective surface 36 and a rear surface, not herein seen. An arm 37 extends rearwardly from the upper longitudinal edge of panel 35. Water deflecting lips 38 extend rearwardly from each edge of panel 35. Only one lip 38 is herein illustrated as extending along one lateral edge of plate 35. It will be appreciated that a similar lip 38 extends along the opposite lateral edge and the lower longitudinal edge. Arm 37 includes flared portion 39 which functions analogously to lip 38. Preferably, the foregoing elements are an integral sheet metal stamping. It is particularly noted that the free end of arm 37 is twisted 90° from flared portion 39.

Clamp means for attachment to shower head 10 is provided by a two-finger spring clip 43 which is received over barrel portion 11 and held thereto by spring tension. An upstanding ear 34 is carried by spring clip 43. Rivet 45 pivotally connects ear 45 with free end 40 of arm 37 in a conventional manner by passing through corresponding respective apertures. Detent means are provided by mating serrations carried by free end 40 and ear 44. Alternately, detent means can be provided by a threaded stud and wing nut arrangement as previously described. Functionally, the immediate embodiment is analogous to the embodiment of FIGS. 1 and 2.

A single manufacturer may provide a line of various shower heads, even as different manufacturers provide different designs. The shower head as seen in FIG. 4 includes barrel member 50 having forward end 51 and rearward end 52. The delivery of water through spray member 53 is controlled by knob 54. In accordance with conventional practice, adjusting knob 54 generally regulates the water, either continuously or incrementally between a very coarse, low pressure spray, and a very fine spray of higher pressure.

The mirror attachment of the instant embodiment includes panel 55, having reflective surface 56, and arm 59 having first end 60 and second end 61. The mirror attachment is secured to the shower head, as is better seen in FIG. 5, by boring or otherwise providing an appropriately sized hole 62 in knob 54, and inserting cylindrical plug 63. Hole 64 in second end 61 of arm 59 also receives plug 63. Shank portion 67 of screw 68 extends through aperture 69 in panel 55, thrust washer 70 and threadedly engages aperture 71 in first end 60 of arm 59. Preferably, plug 63 is tightly received in apertures 62 and 64. Panel 55 is pivotal about screw 68 between a first position as seen in FIG. 4, in which water from the shower head is received against the back side of panel 55, and a second position 180° therefrom, in which the stream of water is unobstructed by panel 55. Alternately, plug 63 may be tightly received in one of the apertures 62 or 64 and loosely received in the other aperture for relative pivotal movement between arm 59 and knob 54. It is also immediately apparent that the frictional fit between plug 63 and apertures 62 and 64 facilitates removal of the mirror attachment from the shower head.

The shower head illustrated in FIG. 6, similar to the shower head of FIG. 4, has a barrel section 72 having first and second ends 73 and 74, respectively. Instead of side-mounted adjusting knob 54, however, the stream of water passing through spray member 77 is regulated by axially located adjusting knob 78. As will be appreciated by those skilled in the art, barrel portion 72 is conventionally fabricated of metal or plastic by such diverse manufacturing techniques as molding, casting and forging. In accordance with one embodiment of the invention, arm 79 is integrally formed with barrel portion 72, resulting in a first free end 80 and a second end 81, which is affixed and blended into the design of barrel portion 72. Panel 82, having reflective surface 83, is functionally analogous to the previously described panel 55 and secured to the free end 80 of arm 79 by screw 84. It is understood that sufficient friction exists between panel 82 and end 80 and screw 84 to retain panel 82 in the operative position, as illustrated, or in an alternate position, wherein the panel is rotated to be remote from the stream of water from spray member 77. It is noted that there are commercially available spring type friction washers for this purpose.

Referring to FIG. 7, there is illustrated an embodiment of the invention comprising a panel 87 and support means 88. For the purpose of illustration, panel 87 is shown as being circular, whereas functionally equivalent elements could be square, rectangular, triangular or free-form. Panel 87 includes front reflective surface 89 and a back surface, not specifically seen herein but understood to be lying in a plane generally parallel to that of reflective surface 89. Support means 88 includes arm 90 having first and second ends 91 and 92, respectively. Panel 89 is secured to first end 91. Clamp 93 is affixed to second end 92 and forms spring biased attaching means for connection to conduit 15. The immediate embodiment is particularly adapted to be inexpensively fabricated as a one-piece, metallic stamping. Alternately, the device could be molded of plastic, having a metallic plated reflective surface or modified to hold a reflective panel. The embodiment is removed when not in use and is readily stowable for use in hotels and motels when the owner and user thereof is traveling.

Figure 8:
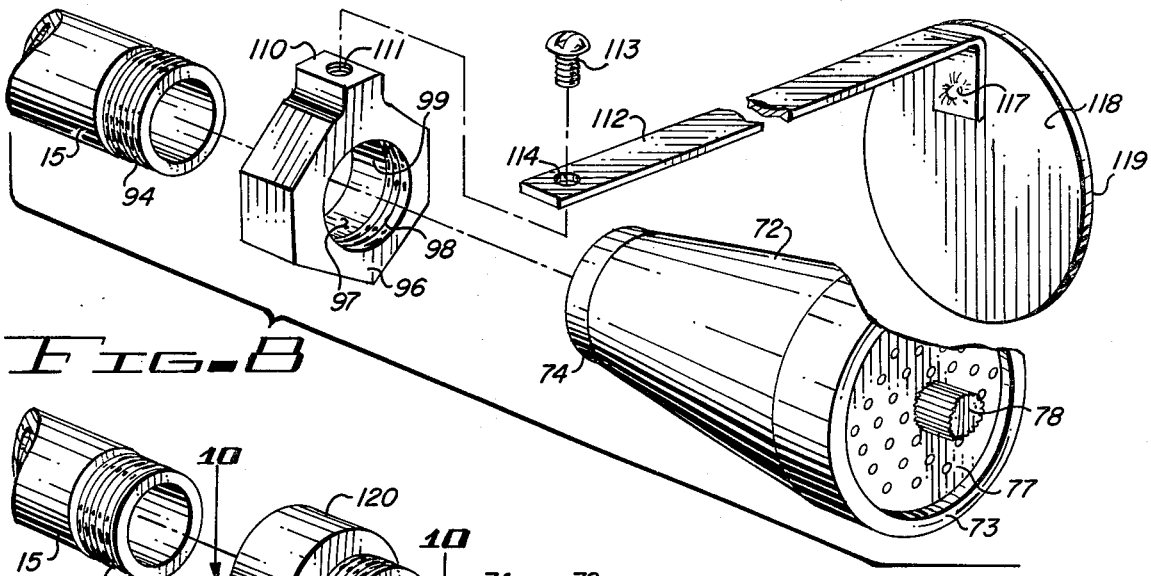
FIG. 8 is an exploded perspective view of a conventional shower head and an alternate embodiment of the instant invention particularly illustrating the mounting means thereof.

Referring now to FIG. 8, barrel portion 72 of the shower head is shown as being separated from conduit 15. As will be readily understood by those skilled in the art, conduit 15 terminates with a threaded end portion 94, which is matingly received within rearward end 74 of barrel member 72. The threaded connection is readily separable and is done from time to time by the user for the purpose of replacing or cleaning the barrel portion.

Collar 96, provided in accordance with the instant embodiment of the invention, has bore 97 therethrough. Bore 97 includes threaded section 98 and counterbore section 99. It is well known that conventional pipe threads are tapered, and that when two elements are united by a pipe thread, the female thread does not receive the entire male thread, leaving a rearward part thereof exposed. Threaded section 98 is sized to receive the rearward portion of threaded end section 94 beyond those threads which are needed for proper engagement of the threads carried by barrel section 72. Counterbore 99 is sized to receive conduit 15. It is readily seen, therefore, that collar 96 is engageable with water delivery conduit 15, without interferring with the normal attachment thereto of barrel section 72. Lug 110 projects radially from collar 96 and has threaded aperture 111 therein. Elongate arm 112 is secured to collar 96 by screw 113, which passes through aperture 114 in arm 112 and threadedly engages threaded aperture 112. Tab 117 depending from arm 112 is affixed as by spot welding to the back side 118 of panel 119. The side of panel 119 not seen is reflective, as in the previous embodiments of the invention. Screw 113, which could also be a pin, rivet, or other fastening device, provides the pivot about which arm 112 is rotated for selective positioning of panel 119.

Figure 9:
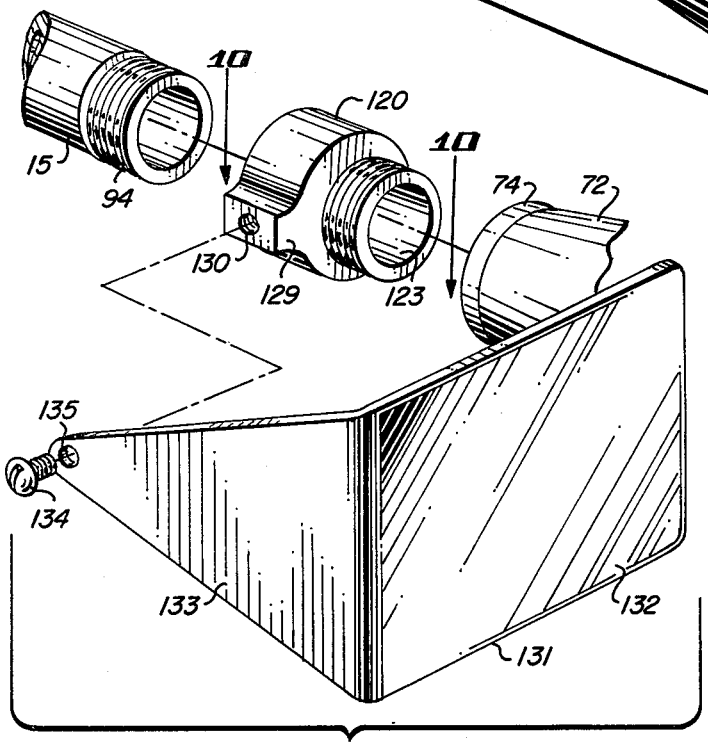
FIG. 9 is an exploded perspective view of yet another alternate embodiment of the instant invention illustrated in combination with a conventional shower, the shower head being shown partially broken away.
Figure 10:
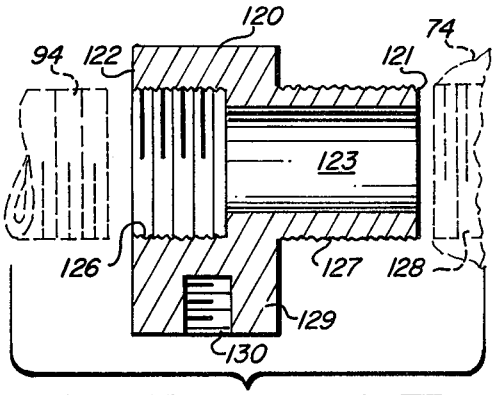
FIG. 10 is a horizontal sectional view taken along the line 10—10 of FIG. 9.

Referring now to FIGS. 9 and 10, illustrated is a coupling 120 having first end 121, second end 122 and bore 123 extending therethrough. Female threaded section 126 extends inwardly from second end 122 and is engageable with threaded end section 94 of conduit 15. Male threaded section 127 proximate first end 121 receives female thread 128 extending inwardly from second end 74 of barrel section 72. Lug 129 extends radially from coupling 120 and carries threaded aperture 130 therein. Panel 131 including reflective surface 132 has arm 133 attached along a lateral edge and extending rearwardly therefrom. Screw 134 extends through aperture 135 and engages threaded aperture 130 for pivotal attachment of panel 131 to coupling 120.

Figure 11:
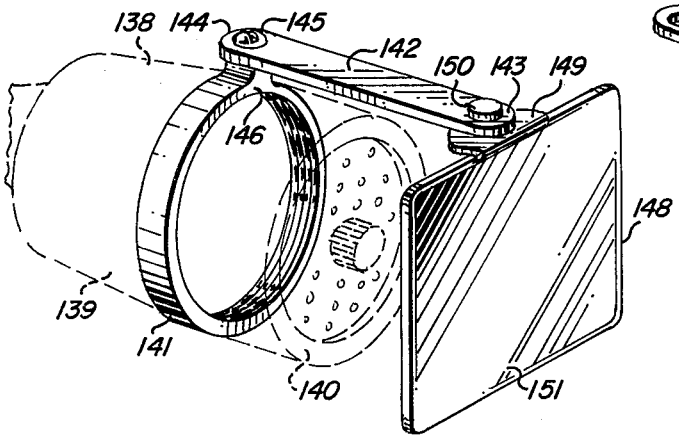
FIG. 11 is a perspective view of an embodiment of the invention having a reflective surface on either side of the panel.

FIG. 11 shows a type of commonly constructed barrel portion 138, having a base section 139 to which is threadedly or otherwise secured a forward section 140. Frequently, this type of shower head construction includes an external annular groove at the junction between the base section and the forward section. Ring 141 is sized and shaped to be received within the groove. This could be accomplished by the user by simply removing section 140 from section 139, installing ring 130 and subsequently reattaching section 140 to section 139. Alternately, ring 141 can be installed by the manufacturer, either using the standard or an especially made groove. Arm 142, having first and second ends 143 and 144, respectively, is pivotally secured to ring 141 by screw 145 received in lug 146 integral with ring 141. Panel 148 has an ear 149 extending rearwardly from the upperhorizontal edge thereof which is pivotally secured to first end 143 by rivet 150.

Panel 148 has a front reflective surface 151. The back surface (not herein seen) of panel 148 is also reflective. Preferably, the front reflective surface and the back reflective surface have different powers of magnification, as can be readily provided by a concavo-convex mirror. Panel 148 is pivotal about rivet 150 to selectively expose either reflective surface for the convenience of the user. When either surface is in use, the other surface functions as the back surface to receive water thereagainst from the shower head. Further, arm 142 is pivotal about screw 145 to selectively place panel 148 in a non-use position.

Figure 12:
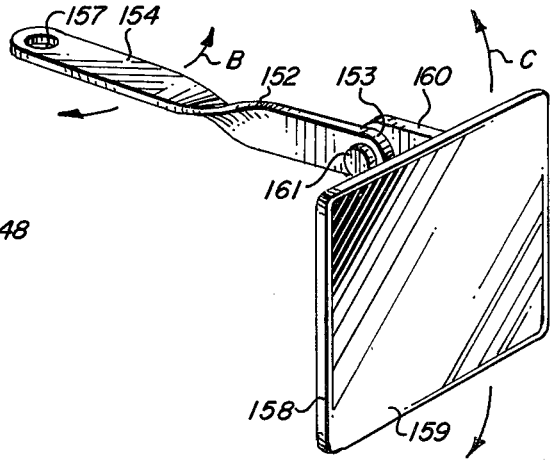
FIG. 12 is a perspective view of a further embodiment of the invention.

The embodiment of the invention presented in FIG. 12 is also usable in combination with ring 141, as described in connection with FIG. 11. Arm 152, having first and second ends 153 and 154, is twisted such that ends 153 and 154 lie in perpendicularly disposed planes. Aperture 157 in second end 154 receives screw 145 thereto for attachment to lug 146 of ring 141. Panel 158 includes front reflective surface 159 and rearwardly projecting ear 160. Rivet 161 pivotally connects ear 160 to first end 153 of arm 152. Panel 158 is shown in the use position. The panel 158 is removed to the remote or non-use position by pivoting arm 152 about screw 145, as indicated by arrow B, or by pivoting panel 158 about rivet 161 relative arm 152, as shown by arrow C.

FIG. 13 illustrates a modified spray member which is adapted to engage a mirror attachment embodiment of the instant invention. Lug 163 having aperture 164 therethrough is attached to the face of spray member 162, and projects through the forward end 167 of barrel member 168 when forward section 169 is engaged with base section 170. Arm 171 extends rearwardly from panel 172, which includes reflective front surface 173. Although panel 172 may assume various shapes, it is illustrated herein as being circular and having arm 171 projecting rearwardly proximate the center thereof and connected by screw 174. Alternately, arm 171 can be secured to panel 172 by spot welding, rivet, or other means well known in the fastening art. Aperture 177 extends through arm 171 proximate the free end thereof. Any suitable fastening device can be used through aperture 164 and aperture 171 to secure the mirror attachment to the shower head. Preferably, the fastening device is in the form of a nut and a bolt to render the mirror attachment readily separable from the shower head.

Ring 178, as viewed in FIG. 14, is attached to the shower head in a manner analogous to ring 141, as described in connection with FIG. 11. Diametrically opposed lugs 179, each having a threaded aperture 180 therein, project from ring 178. Panel 181 has a front reflective surface 182 and a pair of arms 183 extending rearwardly therefrom. Each arm 183 is provided with an aperture 184 which receives a screw 185 therethrough. Screws 185 engage threaded apertures 180 for pivotal attachment of panel 181 to ring 178. Panel 188, as seen in FIGS. 15, is also usable in connection with ring 178, being secured thereto by arms 189. It is noted that while panel 181 is circular, panel 188 is rectangular, each being functionally equivalent.

Illustrated in FIG. 16 is a common type of shower head in which barrel portion 190 has a shaft 191 extending radially therefrom. As will be readily understood by those skilled in the art, rotation shaft 191 operatively moves internal components of the shower head to regulate the water flow through spray member 192. As previously noted herein, the discharge of water from spray member 192 can generally be regulated from a low pressure coarse spray to a higher pressure fine spray. For the convenience of the user, knob 193 is provided with an aperture which receives shaft 191 and is detachably affixed thereto with set screw 194 which bears against flat 197. Indicia corresponding to the various types of water spray are frequently imprinted upon barrel member 190 in a position relative an indicator carried by knob 193. The low pressure spray is commonly characterized by the term "flush".

Arm 198, extending rearwardly from a previously described panel, such as panel 131, has an aperture 199 therethrough. Aperture 199 is sized and shaped to be closely received over shaft 191, including a straight edge 200, which corresponds to flat 197. Straight edge 200, bearing against flat 197, keys arm 198 to shaft 191 for rotation therewith. Preferably, arm 198 is keyed relative shaft 191, such that the panel is in the use position in front of spray member 192 when the spray indicator is registered with the "flush" setting. In this arrangement, low pressure water is received against the back side of the panel to reduce splashing and is remote from the water-stream at the other settings. This will not interfere with normal bathing activities, since the flush position is rarely used by the shower bather.

In accordance with a minor modification of the embodiment of FIG. 16, aperture 199 can be circular and therefore pivotal about shaft 191. In this arrangement, the panel is selectively movable between the use position and the non-use position, without regard to the particular water spray setting. It is also possible that the friction between the arm 198 and knob 193 can be increased, either by a bend in arm 198, a spring washer or other means, whereby arm 198 will rotate with knob 193 and yet can be moved independently thereof by the user.

FIGS. 17 and 18 illustrate a shower head of the general type in which barrel portion 201 includes base section 202 and forward section 203. Forward section 203 as seen in FIG. 17 has a boss 204 including a threaded aperture 205 integrally manufactured therewith. A similar boss 207 is integral with base section 202, as seen in FIG. 18. As illustrated, each boss 204 and 207 is at the top of barrel section 201. Either boss 204 or 207 can be positioned at either side or the bottom of barrel member 201. Since such type shower heads usually include a swivel union between the conduit and the barrel section, barrel section 201 is readily rotatable for selective placement of the boss. The boss provides an attachment for various types of panel and arm arrangements, especially those illustrated in FIGS. 8, 9, 11 and 12. A pair of diametrically opposed bosses would accommodate mere arm arrangements as seen in FIGS. 1, 3, 14 and 15.

The arms extending rearwardly from the various panel embodiments herein illustrated are suggestive of an alternate support means engageable with the shower head for holding the panel in a position for receiving water against the back side thereof. In this regard, attention is particularly directed to panel 181, illustrated in FIG. 14. Panel 181 could be provided with a plurality of short rearwardly extending arms spaced about the periphery thereof. The arms biased inwardly provide a plurality of fingers which grip the forward end of the barrel member for detachable retention of the panel in the use position. The attachment is readily removable when not in use. A similar friction arrangement can be provided centrally on the back side of the panel to engage a central adjusting knob, such as shown at 78 in FIG. 8.

Another common type of shower head includes a spray member having openings only at the periphery thereof adjacent the barrel portion. Frequently, such devices include attachment means, such as a threaded aperture, located centrally in the spray member. Detachably secured thereto is a decorative panel. Within the scope of the instant invention is a panel in which the support means is threaded or otherwise adapted to engage the attachment means within the forward end of the barrel portion.

Various modifications and variations of the embodiments of the invention herein chosen for purposes of illustration will readily occur to those skilled in the art. For example, any of the embodiments can be provided with water deflecting lips, as illustrated in connection with the embodiment of FIG. 3. Similarly, the device in a very specific embodiment has been described as having a mirror and arm section which is an integral sheet metal stamping. A conventional glass mirror may be held in a frame and provide a substitutional equivalent which in a further aspect may be fabricated of plastic. Similarly, in the foregoing descriptions, panels which are made pivotal about a horizontal axis are readily alterable to a vertical axis. And further, while panels of specific embodiments have been illustrated as either circular or rectangular, the functionality of the invention is not altered by utilizing various shaped panels or mirrors in combination with any of the embodiments illustrated.

Finally, it is noted that various embodiments of corresponding elements have been described in detail in the specific combinations in the foregoing detailed description of the preferred embodiments of the instant invention. Such specific arrangements are set forth for the purposes of illustration only, since corresponding elements are largely interchangeable throughout the several embodiments.

Having fully described and disclosed the present invention and the preferred embodiments thereof in such clear and concise terms as to enable those skilled in the art to understand and practice the same, the invention claimed is:

I claim:

1. A bathroom mirror device for use in a shower, said device comprising:

a. a shower head including,
   i. a barrel member having a forward end and a rearward end,
   ii. a conduit communicating with said rearward end for delivering water to said barrel portion;
   iii. a spray member carried proximate said forward end for emitting water from said barrel member;

b. a relatively thin panel having a back surface and a front reflective surface; and c. support means engageable with said shower head for holding said panel in a position in which water from said shower head is received against the back surface of said panel, said panel being thermally responsive to the temperature of said water to prevent condensation of moisture upon said reflective surface.

2. The mirror attachment of claim 1, wherein said support means includes:

a. an arm having first and second ends and secured to said panel proximate said first end and extending rearwardly from said panel; and b. attachment means proximate said second end of said arm for affixing said mirror attachment to said shower head.

3. The mirror attachment of claim 2, wherein said attachment means comprises a clamp detachably receivable about said shower head.

4. The mirror attachment of claim 2, wherein said arm extends from a longitudinal edge of said panel.

5. The mirror attachment of claim 2, wherein said arm extends from a lateral edge of said panel.

6. The mirror attachment of claim 2, including a pair of arms extending from opposed edges of said panel.

7. The mirror attachment of claim 2, wherein said attachment means includes:

a. a lug projecting from said shower head and secured thereto; and b. fastener means interacting between said lug and said arm.

8. The mirror attachment of claim 7, wherein said lug is carried by a collar encircling said shower head.

9. The mirror attachment of claim 1, wherein said support means is detachably securable with said shower head.

10. The mirror attachment of claim 1, further including pivot means for pivotal movement of said panel between a first position in which water from said shower head is received against the back surface of said panel, and a second position in which said panel is remote from said water.

11. The mirror attachment of claim 10, further including detent means associated with said pivot means for selectively retaining said panel in said first position and in said second position.

12. The mirror attachment of claim 1, further including a water deflecting lip extending rearwardly along each edge of said panel.

13. The mirror attachment of claim 1, further including:

a. a back reflective surface carried by said panel and having a magnifying power different than the magnifying power of said front reflective surface; and b. means for operatively reversing said panel relative said support means for selectively exposing either said surface to the water from said shower head.

14. The bathroom mirror attachment of claim 1, wherein said support means are integrally engaged with said shower head.

15. The bathroom mirror device of claim 1, wherein: said support means includes:

a. an intermediate coupling member engageable between said barrel member and said conduit; and b. an arm extending from said intermediate coupling member for holding said panel.

* * * * *